US008641449B2

(12) United States Patent
Cai

(10) Patent No.: US 8,641,449 B2
(45) Date of Patent: Feb. 4, 2014

(54) ELECTRICAL CONNECTOR

(71) Applicant: Lotes Co., Ltd., Keelung (TW)

(72) Inventor: You Hua Cai, Keelung (TW)

(73) Assignee: Lotes Co., Ltd., Keelung (TW)

( * ) Notice: Subject to any disclaimer, the term of this patent is extended or adjusted under 35 U.S.C. 154(b) by 0 days.

(21) Appl. No.: 13/707,277

(22) Filed: Dec. 6, 2012

(65) Prior Publication Data

US 2013/0267118 A1 Oct. 10, 2013

(30) Foreign Application Priority Data

Apr. 10, 2012 (CN) ..... 201220147259 U

(51) Int. Cl.
*H01R 13/648* (2006.01)

(52) U.S. Cl.
USPC ..... 439/607.1; 439/515

(58) Field of Classification Search
USPC ..... 439/607.01, 607.05, 607.09, 607.1, 439/607.12, 607.13, 515, 66
See application file for complete search history.

(56) References Cited

U.S. PATENT DOCUMENTS 5,230,632 A * 7/1993 Baumberger et al. ..... 439/66
5,899,755 A * 5/1999 Kline ..... 439/66
6,027,345 A * 2/2000 McHugh et al. ..... 439/66
6,203,329 B1 * 3/2001 Johnson et al. ..... 439/66
7,114,959 B2 * 10/2006 Stone et al. ..... 439/66
7,121,902 B2 * 10/2006 Gelman et al. ..... 439/862
7,131,850 B2 * 11/2006 Frutschy ..... 439/71
7,156,705 B2 * 1/2007 Soh ..... 439/862
7,329,150 B2 * 2/2008 Ju ..... 439/607.11
7,422,493 B2 * 9/2008 Wang et al. ..... 439/862
8,142,239 B2 * 3/2012 Ueda et al. ..... 439/862
2007/0259540 A1 * 11/2007 Taylor ..... 439/68

* cited by examiner

*Primary Examiner* — Neil Abrams
*Assistant Examiner* — Travis Chambers
(74) *Attorney, Agent, or Firm* — Morris, Manning & Martin, LLP; Tim Tingkang Xia, Esq.

(57) ABSTRACT

An electrical connector includes an insulating body, a plurality of signal terminals, a shielding member, and at least one grounding terminal. The insulating body is provided with at least one first receiving slot and a plurality of second receiving slots. The plurality of signal terminals is respectively received in the second receiving slots. The shielding member has at least one shielding plate disposed inside the insulating body. The at least one grounding terminal is respectively received in the first receiving slot. The grounding terminal has an elastic arm extending upwards and exposed out of the first receiving slot, and the elastic arm has a contact portion correspondingly electrically conducted to the upper shielding layer. The grounding terminal, the annularly disposed shielding plates, the upper shielding layer and the lower shielding layer jointly define a three-dimensional shielding space for the signal terminals.

10 Claims, 5 Drawing Sheets

ELECTRICAL CONNECTOR

CROSS-REFERENCE TO RELATED APPLICATION

This non-provisional application claims priority under 35 U.S.C.§119(a) on Patent Application No. 201220147259.5 filed in P.R. China on Apr. 10, 2012, the entire contents of which are hereby incorporated by reference.

Some references, if any, which may include patents, patent applications and various publications, may be cited and discussed in the description of this invention. The citation and/or discussion of such references, if any, is provided merely to clarify the description of the present invention and is not an admission that any such reference is "prior art" to the invention described herein. All references listed, cited and/or discussed in this specification are incorporated herein by reference in their entireties and to the same extent as if each reference was individually incorporated by reference.

FIELD OF THE INVENTION

The present invention relates generally to an electrical connector, and more particularly to an electrical connector having a three-dimensional shielding space.

BACKGROUND OF THE INVENTION

Currently, to prevent electromagnetic interference among signal terminals, an electrical connector commonly used in a CPU in the industry has a body that is provided with a plurality of receiving slots formed through upper and lower surfaces thereof. The receiving slots are respectively used for accommodating a plurality of grounding terminals and a plurality of signal terminals, and the grounding terminals are arranged between the signal terminals to achieve a shielding effect.

Along with the rapid development of computer technology, the number of CPU cores increases exponentially. Correspondingly, a CPU requires more terminals configured to transmit signals, which causes a rather compact arrangement of terminals, easily leading to interference between the terminals. To achieve a good shielding effect, usually a shielding layer is arranged on the surface of the body and the surface of the receiving slot, and then the grounding terminal is used to conduct interfering signal of the shielding layer to the outside. Since the grounding terminal is fixed inside the receiving slot, extends to form an elastic arm exposed out of the upper surface of the body, and is then elastically pressed by the CPU, if an insufficient upward normal force is provided when the elastic arm is pressed by the CPU, a stable press cannot be achieved due to external impact, which leads to instant disconnection, resulting in instant loss of the shielding effect. This phenomenon often affects the normal operation of the electrical connector.

Therefore, a heretofore unaddressed need exists in the art to address the aforementioned deficiencies and inadequacies.

SUMMARY OF THE INVENTION

In one aspect, the present invention is directed to an electrical connector having a shielding function.

In one embodiment, an electrical connector according to the present invention includes an insulating body for disposing a chip module thereon, a plurality of signal terminals, a shielding member, and at least one grounding terminal. The insulating body is provided with at least one first receiving slot and a plurality of second receiving slots. The plurality of signal terminals are respectively received in the second receiving slots, and respectively electrically connected to the chip module. The shielding member has at least one shielding plate disposed inside the insulating body for shielding the signal terminals disposed in the second receiving slots, and an upper shielding layer, covering an upper surface of the insulating body. The at least one grounding terminal is respectively received in the first receiving slot. The grounding terminal has an elastic arm extending upwards and exposed out of the first receiving slot, and the elastic arm is located above the upper shielding layer. The elastic arm has an urging portion for electrically connecting the chip module, and the elastic arm has a contact portion correspondingly electrically conducted to the upper shielding layer. When the chip module presses the urging portion downwards to cause deformation of the elastic arm, the contact portion presses the upper shielding layer.

In one embodiment, the shielding plate is an electric conductor made of a metal material or non-metal material.

In one embodiment, the upper shielding layer is provided with a plurality of positioning holes corresponding to the first receiving slot and the second receiving slots.

In one embodiment, the electrical connector further includes a lower shielding layer covering a lower surface of the insulating body.

In one embodiment, the lower shielding layer is provided with a plurality of round holes corresponding to the second receiving slots.

In one embodiment, the lower shielding layer is provided with a conducting hole corresponding to the first receiving slot, and the conducting hole has at least one flange.

In one embodiment, the grounding terminal has a soldering portion in electrical contact with the flange.

In one embodiment, the soldering portion and the flange are soldered to a circuit board by using a solder material.

In one embodiment, an insulating layer is formed on the upper shielding layer.

In one embodiment, the upper shielding layer is provided with a plurality of conductive bumps in electrical contact with the contact portions.

As compared with the related art, in the electrical connector of the present invention, among other things, the insulating body has the shielding plate, the upper shielding layer and the lower shielding layer for isolating the signal terminals, and the flange of the lower shielding layer is electrically connected to the soldering portion of the grounding terminal and thus grounded, where at least one grounding terminal is mounted between the signal terminals. When the chip module tightly presses the urging portion to cause deformation of the elastic arm, the contact portion presses and electrically contacts the upper shielding layer, so that the elastic arm provides a normal force for contacting the chip module, thereby avoiding interference between the signal terminals resulting from instant loss of the shielding effect when the electrical connector is under an external force. The grounding terminal, the annularly disposed shielding plates, the upper shielding layer and the lower shielding layer jointly define a three-dimensional shielding space, so that the signal terminals inside the three-dimensional shielding space achieve a desirable shielding effect. In other embodiments, the contact portion may also be maintained in electrical contact with the upper shielding layer.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment, and wherein.

DETAILED DESCRIPTION OF THE INVENTION

Figure 1:
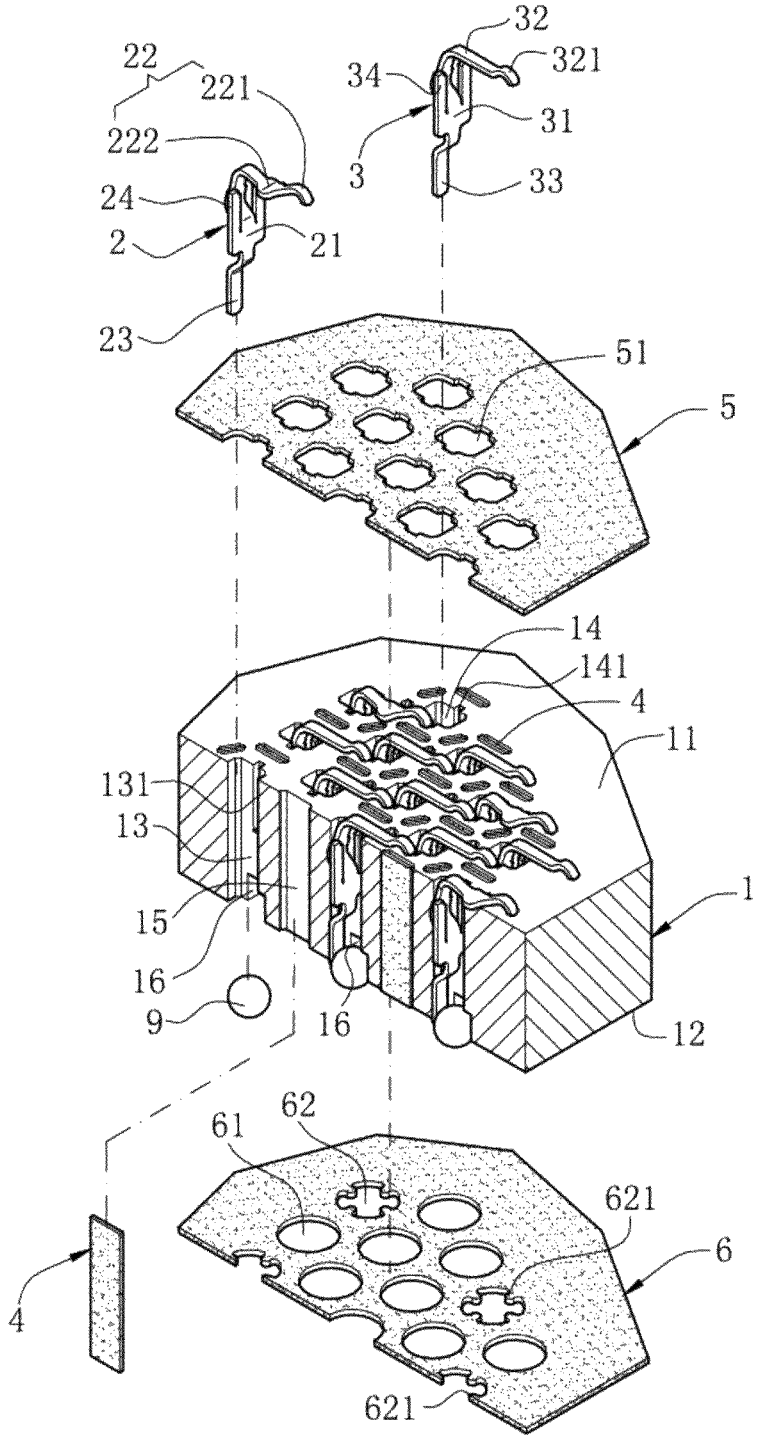
FIG. 1 is a schematic exploded view of an electrical connector according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

Figure 2:
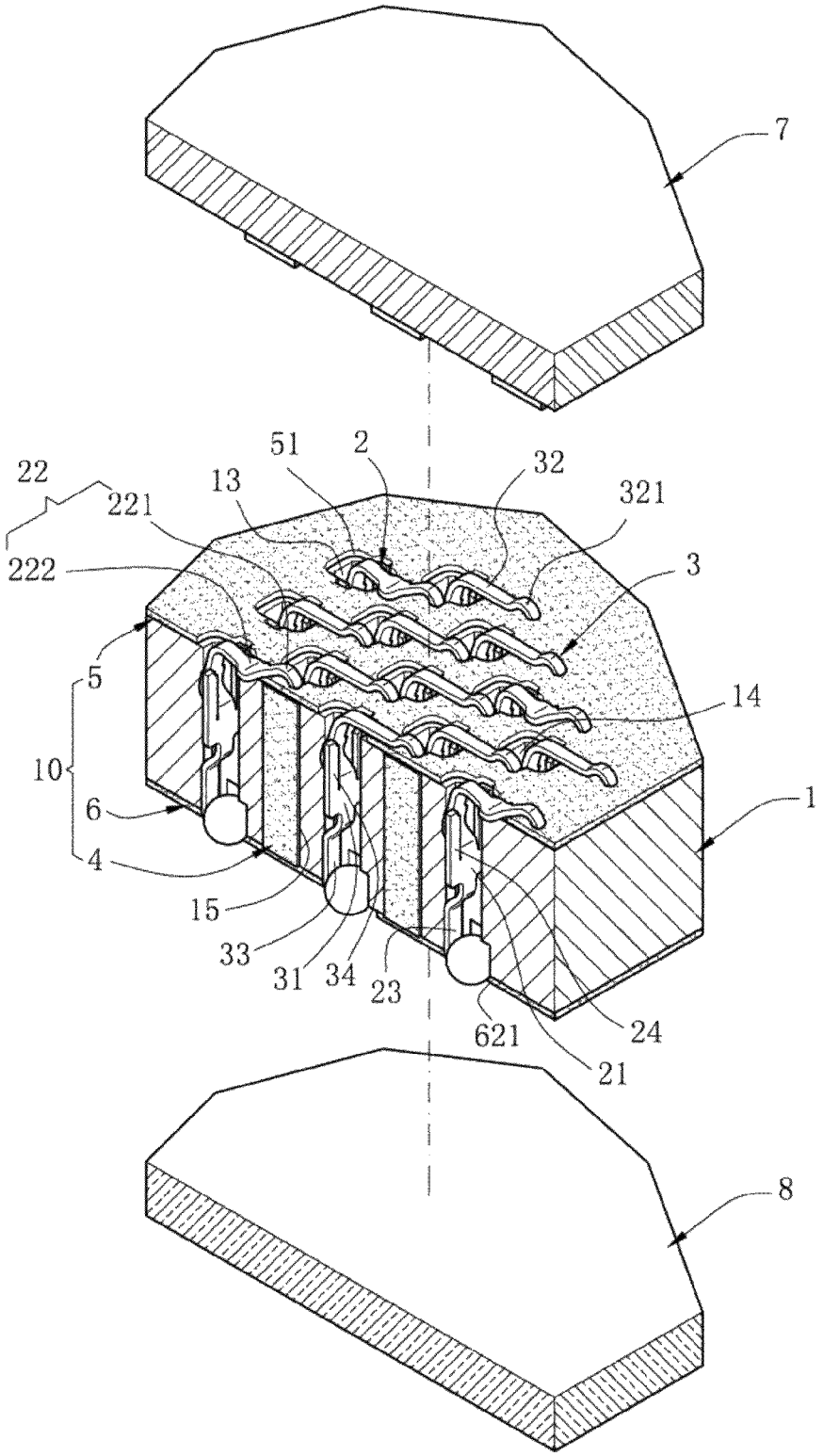
FIG. 2 is a schematic three-dimensional view of an electrical connector according to one embodiment of the present invention.

FIGS. 1 and 2 show an electrical connector usable for mounting a chip module 7 onto a circuit board 8. The electrical connector includes an insulating body 1, a plurality of grounding terminals 2, a plurality of signal terminals 3, a shielding member 10, and solder balls 9.

The insulating body 1 has an upper surface 11 and a lower surface 12. A plurality of first receiving slots 13, second receiving slots 14 and through holes 15 are formed through the upper surface 11 and the lower surface 12. Each of the first receiving slots 13 has a first retaining hole 131, and each of the second receiving slots 14 has a second retaining hole 141. Lower ends of the first receiving slots 13 and the second receiving slots 14 have a plurality of recesses 16 for accommodating the solder balls 9. The through holes 15 are respectively arranged around the first receiving slots 13 and the second receiving slots 14. In other embodiments, the through holes 15 may be arranged around the second receiving slots 14.

The grounding terminal 2 has a base 21, an elastic arm 22 extending upwards from the base 21, a soldering portion 23 extending downwards from the base 21, and two retaining portions 24 extending laterally from the base 21. The elastic arm 22 has a contact portion 222, and an urging portion 221 extending upwards from the contact portion 222.

The signal terminal 3 has a body portion 31, an extending arm 32 extending upwards from the body portion 31, a soldering leg 33 extending downwards from the body portion 31, and two clamping portions 34 extending laterally from the body portion 31. One end of the extending arm 32 has a engaging portion 321.

The shielding member 10 has a plurality of shielding plates 4, an upper shielding layer 5, and a lower shielding layer 6. The shielding plate 4 is a flat plate made of a metal material. The upper shielding layer 5 is provided with positioning holes 51 corresponding to the first receiving slots 13 and the second receiving slots 14. The positioning holes 51 are larger than upper openings of the second receiving slots 14. The lower shielding layer 6 is provided with round holes 61 corresponding to the second receiving slots 14. The round holes 61 are larger than lower openings of the second receiving slots 14. The lower shielding layer 6 is provided with conducting holes 62 corresponding to the first receiving slots 13, and each of the conducting holes 62 has at least one flange 621. In this embodiment, the number of the flanges 621 is four.

In other embodiments, the shielding plate 4, the upper shielding layer 5 and the lower shielding layer 6 may be, conductors made of non-metal materials, composite conductors, conductive ceramics or the like.

In other embodiments, a metal conductive layer is formed by spray plating on the upper surface 11 and the lower surface 12 of the insulating body 1 and inner side walls of the through holes 15, so as to form a plurality of three-dimensional shielding spaces.

Figure 3:
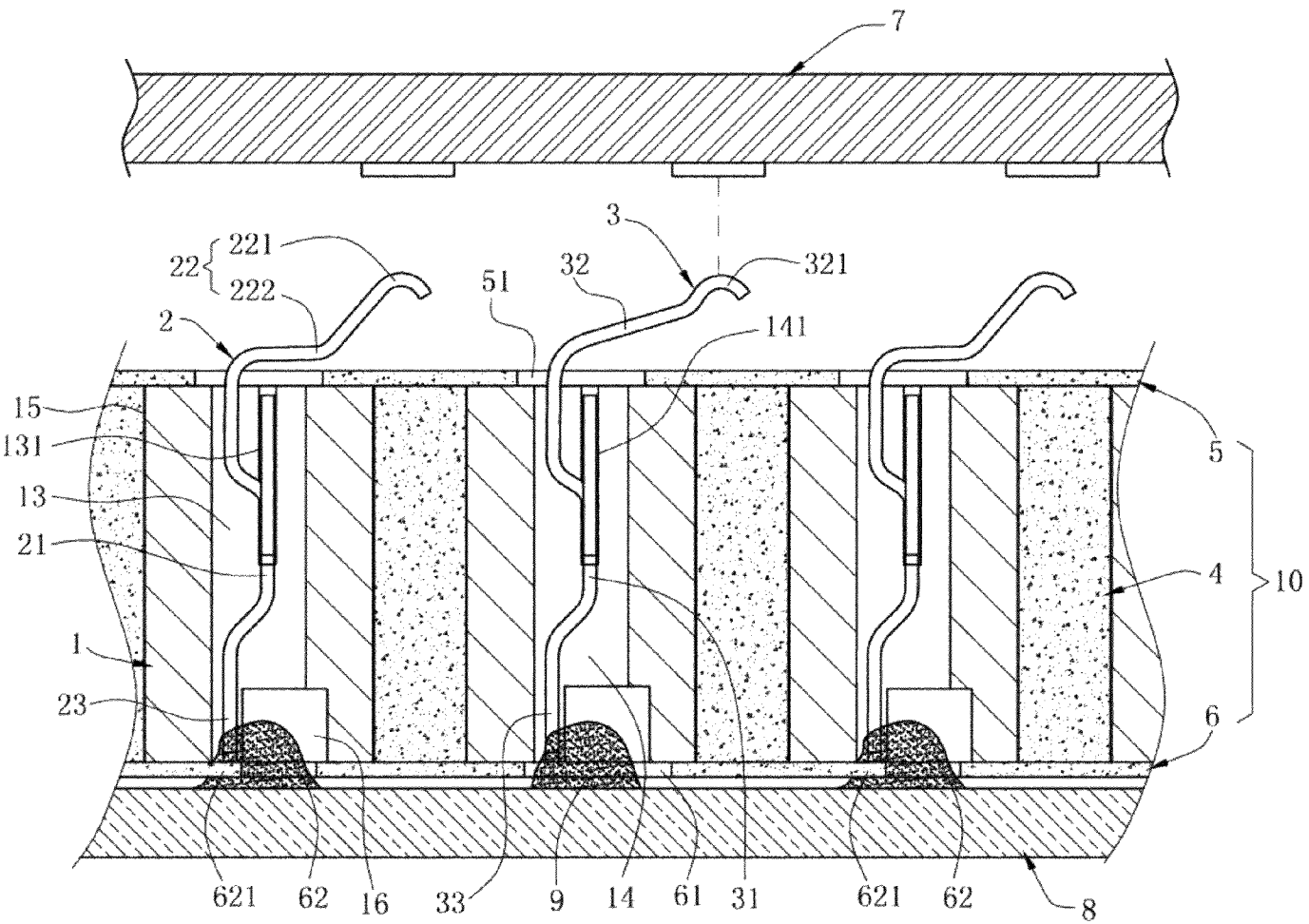
FIG. 3 is a sectional view of an electrical connector according to one embodiment of the present invention when no chip module is placed.

During assembly, referring to FIGS. 1-3, first, the shielding plates 4 are correspondingly placed inside the through holes 15, and then the upper shielding layer 5 is placed on the upper surface 11, so that the positioning holes 51 correspond to the first receiving slots 13 and the second receiving slots 14. Further, the lower shielding layer 6 is placed on the lower surface 12, so that the round holes 61 correspond to the second receiving slots 14, and the conducting holes 62 correspond to the first receiving slots 13. In this embodiment, the shielding plates 4, the upper shielding layer 5 and the lower shielding layer 6 may be placed and positioned in an injection mold first, followed by injection of plastic, thereby forming the insulating body 1.

Next, the grounding terminals 2 are disposed inside the first receiving slots 13, so that the retaining portions 24 are located and caught inside the first retaining holes 131. The elastic arms 22 pass through the positioning holes 51 to be exposed above the upper shielding layer 5. The soldering portions 23 electrically contact the flanges 621. In this embodiment, the grounding terminals 2 may also be otherwise distributed around the signal terminals 3. Alternatively, the number of the grounding terminal 2 may also be one.

Further, the signal terminals 3 are disposed inside the second receiving slots 14, so that the clamping portions 34 are located and caught inside the second retaining holes 141. The extending arms 32 pass through the positioning holes 51 to be exposed above the upper shielding layer 5. The engaging portions 321 are located above the upper shielding layer 5. In addition, the engaging portions 321 always do not contact the upper shielding layer 5, and the soldering legs 33 are located below the second receiving slots 14.

The solder balls 9 are correspondingly placed into the recesses 16. The soldering portions 23 and the flanges 621 are soldered to the circuit board 8 by using the solder balls 9 and grounded, and the soldering legs 33 are soldered to the circuit board 8 by using the solder balls 9.

Figure 4:
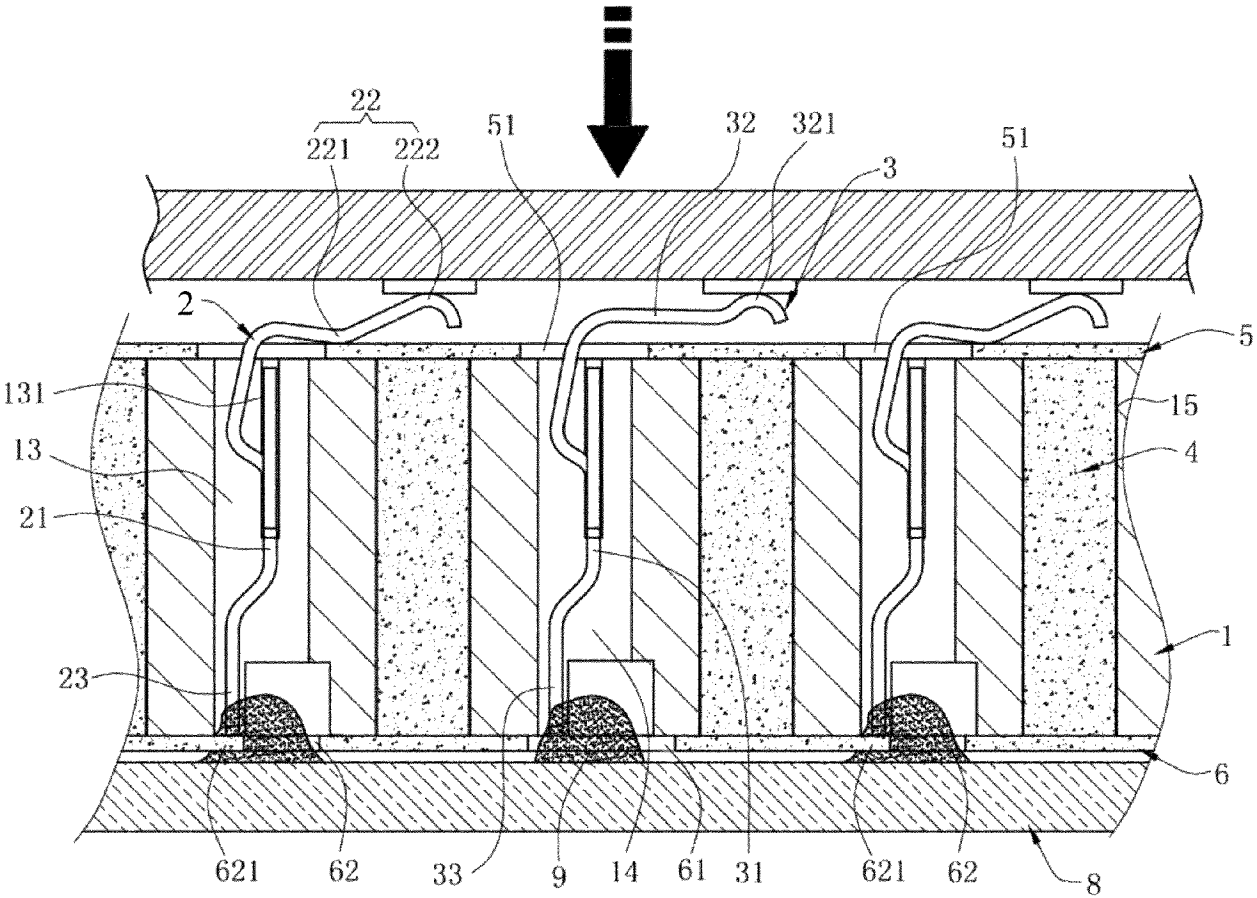
FIG. 4 is a sectional view of an electrical connector according to one embodiment of the present invention when a chip module is placed.

Referring to FIGS. 3 and 4, when the chip module 7 tightly presses the engaging portion 321, the extending arm 32 is close to and spaced from the upper shielding layer 5. The chip module 7 tightly presses the urging portion 221 to cause deformation of the elastic arm 22, so that the contact portion 222 presses and electrically contacts the upper shielding layer 5. At this time, the fulcrum of the arm of force of the elastic arm 22 is the closest to the contact portion 222. Therefore, the arm of force is shortened, leading to reduced elasticity and increased strength of the elastic arm 22. In this way, the elastic arm 22 provides an upward normal force, which ensures that the elastic arm 22 is in stable contact with the chip module 7 when the electrical connector vibrates under an external force, thereby avoiding interference between the signal terminals 3 resulting from instant loss of the shielding effect. In this embodiment, the contact portion 222 may also be maintained in electrical contact with the upper shielding layer 5.

The grounding terminals 2, the annularly disposed shielding plates 4, the upper shielding layer 5 and the lower shielding layer 6 jointly define a plurality of three-dimensional shielding spaces, that is, the shielding member 10 and the grounding terminals 2 define a plurality of three-dimensional shielding spaces, so that each signal terminal 3 inside the three-dimensional shielding space can achieve a desirable shielding effect.

Figure 5:
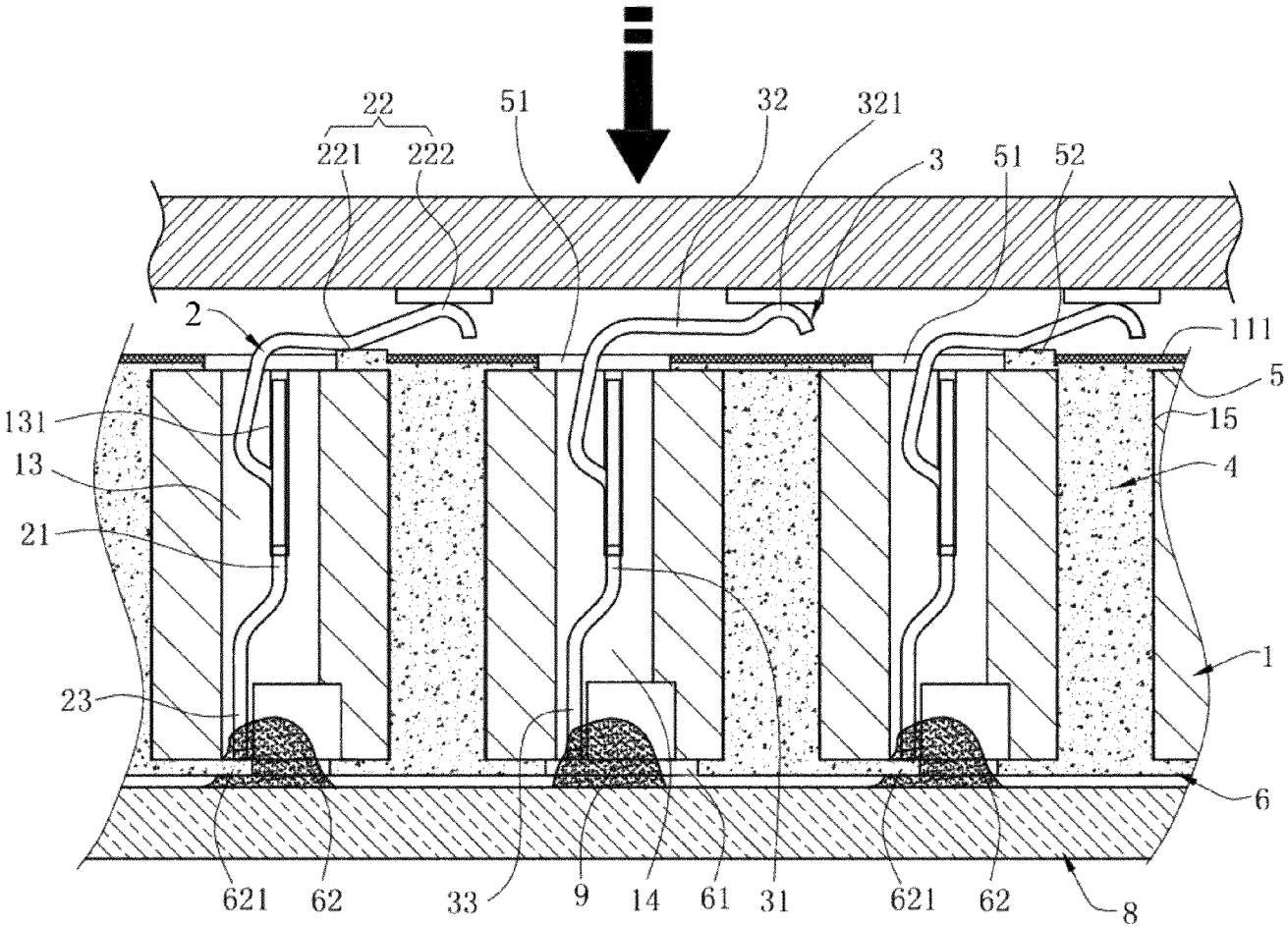
FIG. 5 is a schematic view of another embodiment of the present invention.

In another embodiment, referring to FIG. 5, an insulating layer 111 is formed on the upper shielding layer 5. The insulating layer 111 prevents short circuit when the extending arm 32 of the signal terminal 3 is pressed downwards to contact the upper shielding layer 5. The upper shielding layer 5 is provided with a plurality of conductive bumps 52 maintained in electrical contact with the contact portion 222 of the grounding terminal 2, so as to ensure that the elastic arm 22 provides a normal force for contacting the chip module 7, thereby avoiding the phenomenon of instant disconnection.

Based on the above, the electrical connector of the present invention, among other things, has the following beneficial advantages.

(1) The grounding terminals 2, the annularly disposed shielding plates 4, the upper shielding layer 5 and the lower shielding layer 6 jointly define a plurality of three-dimensional shielding spaces, that is, the shielding member 10 and the grounding terminals 2 define a plurality of three-dimensional shielding spaces, so that each signal terminal 3 inside the three-dimensional shielding space can achieve a desirable shielding effect.

(2) The chip module 7 tightly presses the urging portion 221 to cause deformation of the elastic arm 22, so that the contact portion 222 presses and electrically contacts the upper shielding layer 5. At this time, the fulcrum of the arm of force of the elastic arm 22 is the closest to the contact portion 222. Therefore, the arm of force is shortened, leading to reduced elasticity and increased strength of the elastic arm 22. In this way, the elastic arm 22 provides an upward normal force, which ensures that the elastic arm 22 is in stable contact with the chip module 7 when the electrical connector vibrates under an external force, thereby avoiding interference between the signal terminals 3 resulting from instant loss of the shielding effect.

(3) In another embodiment, an insulating layer 111 is spray-plated on the upper shielding layer 5. The insulating layer 111 prevents short circuit when the extending arm 32 of the signal terminal 3 is pressed downwards to contact the upper shielding layer 5.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, for electrically connecting a chip module, comprising:

an insulating body, for disposing the chip module thereon, wherein the insulating body is provided with at least one first receiving slot and a plurality of second receiving slots;

a plurality of signal terminals, respectively received in the second receiving slots, and respectively electrically connected to the chip module;

a shielding member, having at least one shielding plate disposed inside the insulating body, and for shielding the signal terminals disposed in the second receiving slots;

an upper shielding layer, covering an upper surface of the insulating body;

at least one grounding terminal, respectively received in the first receiving slot, wherein the grounding terminal has an elastic arm extending upwards and exposed out of the first receiving slot, the elastic arm is located above the upper shielding layer, the elastic arm has an urging portion for electrically connecting the chip module, and a contact portion correspondingly electrically conducted to the upper shielding layer, wherein when the chip module presses the urging portion downwards to cause deformation of the elastic arm, the contact portion presses the upper shielding layer.

2. The electrical connector according to claim 1, wherein the shielding plate is an electric conductor made of a metal material or non-metal material.

3. The electrical connector according to claim 1, wherein the upper shielding layer is provided with a plurality of positioning holes corresponding to the first receiving slot and the second receiving slots.

4. The electrical connector according to claim 1, wherein the electrical connector further comprises a lower shielding layer covering a lower surface of the insulating body.

5. The electrical connector according to claim 4, wherein the lower shielding layer is provided with a plurality of round holes corresponding to the second receiving slots.

6. The electrical connector according to claim 4, wherein the lower shielding layer is provided with a conducting hole corresponding to the first receiving slot, and the conducting hole has at least one flange.

7. The electrical connector according to claim 6, wherein the grounding terminal has a soldering portion in electrical contact with the flange.

8. The electrical connector according to claim 7, wherein the soldering portion and the flange are soldered to a circuit board by using a solder material.

9. The electrical connector according to claim 1, wherein an insulating layer is formed on the upper shielding layer.

10. The electrical connector according to claim 9, wherein the upper shielding layer is provided with a plurality of conductive bumps in electrical contact with the contact portions.

* * * * *